US006547707B2

(12) United States Patent
Cote

(10) Patent No.: US 6,547,707 B2
(45) Date of Patent: Apr. 15, 2003

(54) STRAIN CONTROL IN AN INFEED OF A PRINTING MACHINE

(75) Inventor: Kevin Lauren Cote, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/758,312

(22) Filed: Jan. 10, 2001

(65) Prior Publication Data

US 2002/0123417 A1 Sep. 5, 2002

(51) Int. Cl.[7] ..... B31B 1/10

(52) U.S. Cl. ..... 493/13; 493/10; 493/18; 242/417.3; 242/563

(58) Field of Search ..... 493/9, 10, 13, 493/18; 242/420.6, 421.1, 538.3, 541.7, 421.7, 421.6, 417.2, 417, 417.1, 417.3, 563; 226/44

(56) References Cited

U.S. PATENT DOCUMENTS 3,822,838 A * 7/1974 Butler et al. ..... 242/417.2
3,936,008 A * 2/1976 Crum ..... 242/421.1
4,015,794 A * 4/1977 Meihofer ..... 242/421.7
4,151,594 A * 4/1979 Stern ..... 242/421.1
4,552,317 A * 11/1985 Halter ..... 242/541.7
4,709,872 A * 12/1987 Hammer et al. ..... 242/421.6
4,775,086 A * 10/1988 Kataoka ..... 226/44
5,176,334 A * 1/1993 Dreschau et al. ..... 226/44
5,314,133 A * 5/1994 Sandner et al. ..... 242/538.3
5,657,941 A * 8/1997 Simons et al. ..... 242/420.6

* cited by examiner

*Primary Examiner*—Rinaldi I. Rada
*Assistant Examiner*—Hemant M Desai
(74) *Attorney, Agent, or Firm*—Laurence A. Greenberg; Werner H. Stemer; Gregory L. Maybeck

(57) ABSTRACT

In some process contexts it is desirable to maintain a constant strain on the web instead of constant tension. The novel system measures the caliper of the web material and adjusts the tension to achieve the desired constant strain. The caliper may be measured by monitoring the radius of the expiring web reel in connection with the angular position of the reel. The web caliper is input into a control scheme that includes an algorithm determining the appropriate tension to applied to the web in accordance with its caliper. The control scheme outputs a variable force command to a dynamic dancer which adjusts the web tension and thus sets the constant web strain. The variable force may be injected via an air cylinder, a hydraulic cylinder, a spring with a dynamic ground, or an electromagnetically driven actuator.

8 Claims, 2 Drawing Sheets

STRAIN CONTROL IN AN INFEED OF A PRINTING MACHINE

BACKGROUND OF THE INVENTION

FIELD OF THE INVENTION

The invention lies in the field of paper handling devices and pertains, more specifically, to a system in the infeed of a web-fed printing machine for controlling the tension on the web.

The infeed in a printing machine is disposed between a reelstand, which holds a reel with a continuous web, and the following printing units. The function of the infeed is to maintain proper web tension in the printing units and to correctly align the paper web. Web tension is adjusted in the infeed with so-called dancer rollers disposed between the pull rollers, which pull the paper web from the reel, and the printing units. One of more web tension measuring rollers are disposed to measure the web tension at all times. Besides the primary pulling forces, the web tension is subject to variations due to differences in the elasticity of the paper web, the relative humidity, faults in the web unwinding from the reel, or splicing.

Existing infeed configurations are maximized to maintain a constant web tension. Since tension is defined as the ratio of the pulling force to the cross-sectional area of web, the strain on the web varies with the caliper of the web material—even if the pulling force remains constant. For some processes it is desirable to maintain a constant strain in the web. Current infeed configurations which maintain constant web tension are not equipped to measure web strain and to maintain a constant web strain.

SUMMARY OF THE INVENTION

It is accordingly an object of the invention to provide a strain control system for a web-fed printing machine, which overcomes the above-mentioned disadvantages of the heretofore-known devices and methods of this general type and which enables web strain control and which allows a constant strain to be maintained on the infeed web.

With the foregoing and other objects in view there is provided, in accordance with the invention, a strain control configuration in a web-processing machine, comprising:

- a reel carrying a continuous web of material and disposed to rotate for paying out the web and feeding the web to a process;
- a measuring device for measuring a caliper of the web material;
- a tension setting device for setting a tension of the web entering the process; and
- a drive circuit connected to the measuring device and to the tension setting device, the drive circuit controlling the tension of the web via the tension setting device in dependence on the caliper of the web material to maintain a substantially constant strain on the web.

In other words, some processes are improved if a constant strain is set on the web instead of constant tension. The novel system measures the caliper of the web material and adjusts the tension to achieve the desired constant strain. The caliper may be measured by monitoring the radius of the expiring web reel in connection with the angular position of the reel. The web caliper is input into a control scheme that includes an algorithm determining the appropriate tension to applied to the web in accordance with its caliper. The control scheme outputs a variable force command to a dynamic dancer which adjusts the web tension and thus sets the constant web strain.

In accordance with an added feature of the invention, the measuring device comprises a sensor disposed to measure a diameter of the reel and a sensor for sensing an angular position of the reel.

In accordance with an additional feature of the invention, the tension setting device includes a dancer roller about which the web is deflected and a device for controlling a position of the dancer roller for selectively increasing and decreasing a deflection of the web between the reel and the process.

In accordance with another feature of the invention, the tension setting device further includes a piston/cylinder assembly operatively connected to the dancer roller and a pressure regulator communicating with the piston/cylinder assembly for adjusting a position of the dancer roller.

The variable force may be injected via an air cylinder, a hydraulic cylinder, a spring with a dynamic ground, or an electromagnetically driven actuator.

In accordance with a further feature of the invention, the drive circuit is configured to calculate the caliper of the web material and programmed to adjust the tension of the web in dependence on the caliper to maintain a substantially constant strain on the web.

In accordance with again an added feature of the invention, the drive circuit is configured to adjust the strain on the web to a desired strain set at a given input of the drive circuit.

In accordance with again an additional feature of the invention, the drive circuit comprises a processor for calculating a desired tension required to maintain the substantially constant strain on the web, and a first converter for converting a signal representing the desired tension to a signal representing a force to be applied to the web.

In accordance with again a further feature of the invention, the drive circuit further comprises a second converter connected to the first converter for converting the signal representing the force to a signal representing a pressure to be applied to a pressure regulator defining the tension on the web.

In accordance with a concomitant feature of the invention, the drive circuit further comprises a feedback loop for iteratively correcting and driving an output signal thereof to a desired strain set at an input thereof.

Other features which are considered as characteristic for the invention are set forth in the appended claims.

Although the invention is illustrated and described herein as embodied in a strain control in a web-fed printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
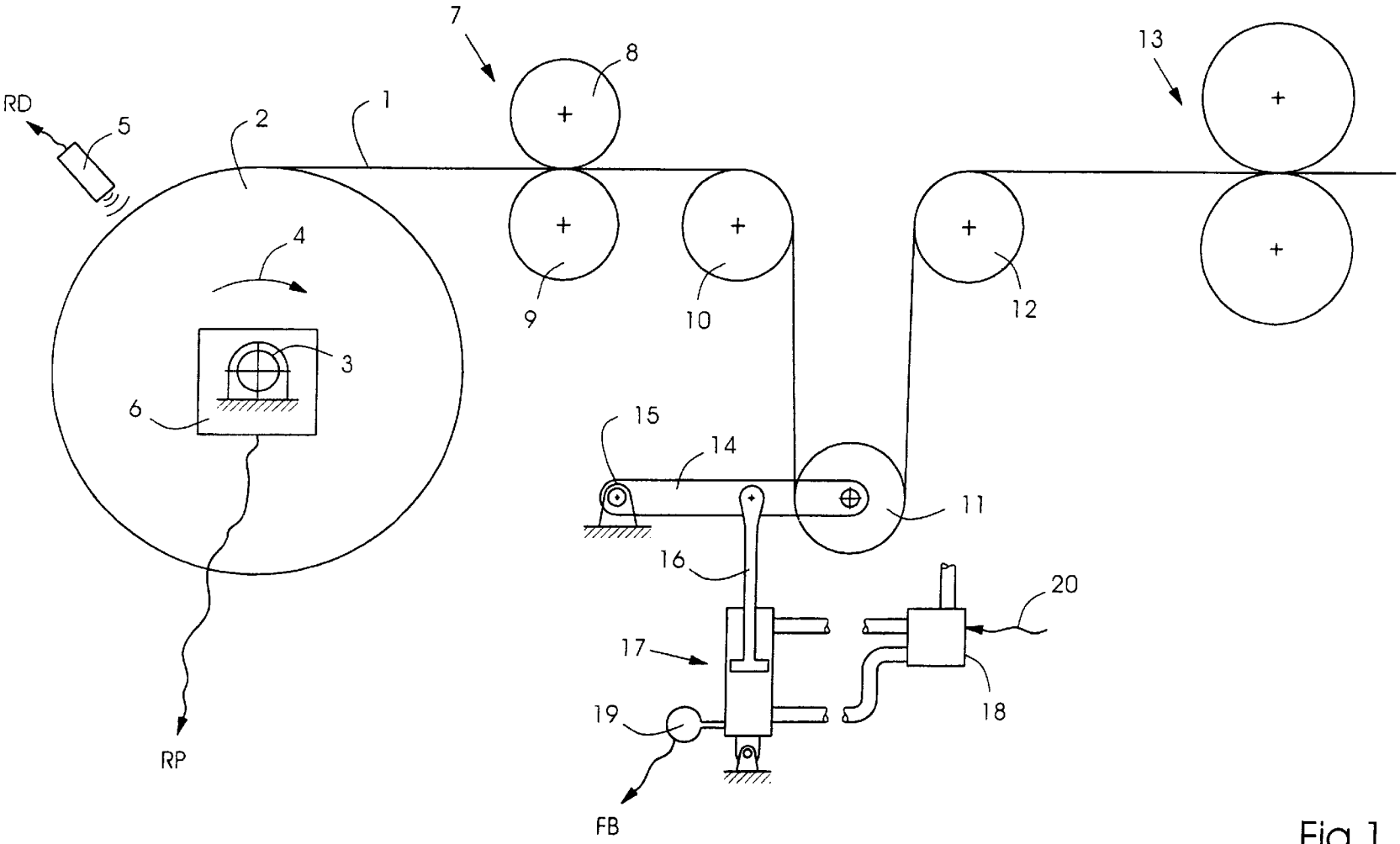
FIG. 1 is a diagrammatic side view of an infeed configuration with a tension/strain control system according to the invention.

Referring now to the figures of the drawing in detail and first, particularly, to FIG. 1 thereof, a web 1 of material is unwound from a reel 2 on a reelstand 3. The reel 2 rotates in the direction of an arrow 4. A caliper sensor 5 is disposed to monitor the radius or diameter of the expiring reel 2. The sensor 5 has an output signal RD proportional to the reel diameter. The angular position of the reel 2 is measured with a sensor 6. The sensor 6 has an output signal RP proportional to the reel position.

A pull roller 7, formed by a roller pair including a driven roller 8 and a pressure roller 9, pulls the web 1 from the reel 2. Following the pull roller 7, the web 1 travels about an idle roller 10, a dancer roller 11, and a further idle roller 12. From there, the web 1 enters the process, such as a first printing unit indicated by a roller pair 13.

The dancer roller 11 controls the tension of the web 1. The dancer roller 11 is rotatably mounted on a free end of a swing arm or rocker arm 14, the other end of which is articulated about a frame-stationary axis 15. The rocker arm 14 is pivoted by a piston rod 16 which is actuated by a piston of a piston/cylinder assembly 17. The primary and secondary pressure chambers of the piston/cylinder assembly 17 communicate with a pressure regulator 18. In a preferred embodiment, the piston/cylinder assembly 17 and the pressure regulator 18 may be connected in a pneumatic loop or in a hydraulic loop. It will be understood, however, that the rocker arm 14 can also be moved by any other actuator, such as an electric spindle drive or a magnetic actuator. In that case, the pressure regulator 18 is integrated in the assembly 17 and driven directly by a drive signal 20. The latter is output by the driver circuit illustrated in FIG. 2.

A pressure inside the piston/cylinder assembly 17 is measured by a pressure transducer 19. The pressure transducer 19 has an output signal FB which is proportional to the tension applied on the web 1 by the dancer roller 11. The output signal FB is used as a corrective feedback signal in the driver circuit of FIG. 2.

Figure 2:
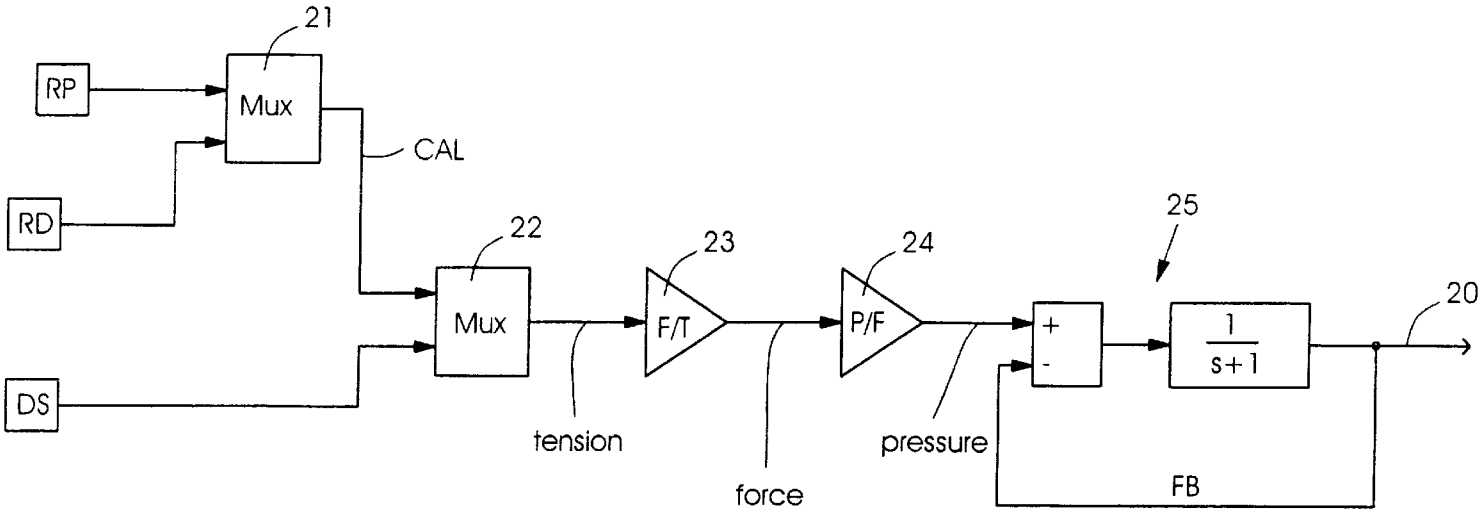
FIG. 2 is a schematic diagram of a processing system with a caliper feedback strain control for the configuration illustrated in FIG. 1.

Referring now more particularly to FIG. 2, the driver circuit receives the two sensor output signals RP (reel position, sensor 6) and RD (reel diameter, sensor 5). A first processor stage 21 calculates a paper web caliper from the two sensor signals RD and RP. The web caliper is the thickness of the web, as represented, for example, by the difference in the roll diameter $\Delta_{RD}$ for each revolution of the reel 2 (RP+2π) The caliper of the web is output by the first processor stage 21 as a signal CAL.

A second processor stage 22 receives as its input signals the caliper signal CAL and a setting representing the desired strain DS to be maintained by the dancer roller 11 via the intermediary of the piston/cylinder assembly 17 and the rocker arm 14. The second processor stage 22 calculates the desired tension to be maintained so as to obtain the desired constant strain DS.

Figure 3:
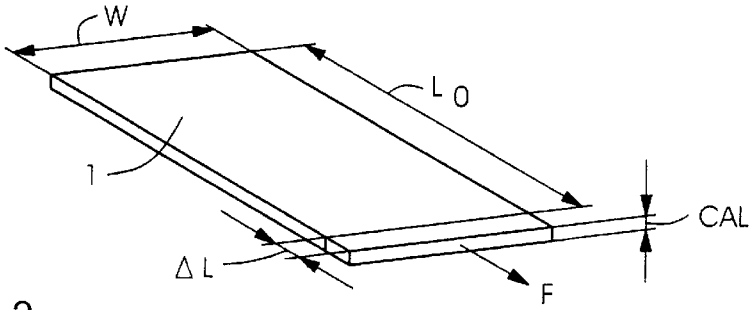
FIG. 3 is a perspective view of a unit length of web material.

Referring now to FIG. 3, the following definitions and terms are used with regard to the web 1. The web 1 has a given width W which constant for each reel. A thickness of the web is referred to as its caliper CAL. When a force F stretches the web 1, its "relaxed" length $L_o$ is extended by a length ΔL. The strain on the web is defined as a ratio $\Delta L/L_o$—a dimensionless quantity. The tension on the web is defined as a ratio of the pulling force F to the cross-sectional area A (W.CAL) of the web. Strain and tension are proportional to one another as $$\frac{F}{A} = Y\frac{\Delta L}{L_o},$$

where the proportionality factor Y is referred to as Young's modulus. In simple terms, Young's modulus is known for a given material as its elasticity along its longitudinal axis or its stretch elasticity.

Returning once more to FIG. 2, the second processor stage 22 thus calculates the tension that is to be applied to the web 1 so as to maintain the constant strain. In a first converter stage 23, the tension signal is converted into a force signal which represents the force necessary to place the required tension on the web and thus to maintain the proper strain. The force signal is then converted, in a second converter stage 24, into a pressure signal which represents the pressure to which the piston/cylinder loop must be subjected in order to have the dancer roller 11 put the proper tension onto the web 1.

As noted above, the hydraulic or pneumatic loop with the piston/cylinder driving the piston rod 16 is merely one of several embodiments that are possible. If the rocker arm 14 or the bearing of the roller 11 is directly actuated with an electronically driven actuator, the second converter stage 24 may be omitted from the driver circuit of FIG. 2.

The signal "pressure" output by the second converter 24 is input to a controller 25 with a feedback loop. The controller 25 defines the signal 20 that is input into the pressure regulator 18 which, in turn, adjusts the tension and thus the strain on the web 1. The controller 25 operates on a transfer function $$G_c = \frac{1}{s+1}$$

and a feedback loop. The closed-loop system obtains its error signal from the sensor 19 which returns the signal FB representing the tension on the web 1.

The closed-loop driver controller 25 may be a proportional-integral (PI) controller and the transfer function $G_C$ may include a proportional gain and an integrated term with the integral gain of the feedback loop. The transfer function $G_C$ illustrated here uses the Laplace differential operator $$s \equiv \frac{d}{dt}$$

and the term 1/s represents the integral operator $$\frac{1}{s} \equiv \int_{0+}^{t} dt.$$

The integral operator represents the unit step 1 in the Laplace transform. The controller 25 may be followed by a non-illustrated min-max limiter which limits the controller output signals to the maximum settings. These details are not illustrated for purposes of clarity.

The output signal 20 represents the real-time tension that is applied to the web 1 via the dancer roller 11. The signal 20 is formed by multiplying the proportional gain component of the transfer function $G_C$ with the error signal that is obtained by adding the feedback signal FB and the output signal of the converter 24 in an adder upstream of the transfer function controller.

The transient response of the tensioning system depends on the scanning frequency of the various sensors and on the tension calculation. The object, of course, is to run the feedback signal FB (i.e., the output signal 20) to the "pressure" signal so as to reduce the error between the signals "pressure" and FB to zero.

I claim:

1. A strain control configuration in a web-processing machine, comprising:

a reel carrying a continuous web of material and disposed to rotate for paying out the web and feeding the web to a process;

a measuring device for measuring a caliper of the web material, said measuring device having a sensor disposed to measure a diameter of said reel and a sensor for sensing an angular position of said reel;

a tension setting device for setting a tension of the web entering the process; and a drive circuit connected to said measuring device and to said tension setting device, said drive circuit receiving values of said sensors, calculating the caliper from the values at a first processor stage, and combining the calculated value as an input signal with a signal representing a desired strain at a second processor stage, said drive circuit controlling the tension of the web via said tension setting device in dependence on the calculated caliper of the web material to maintain a substantially constant strain on the web.

2. The strain control configuration according to claim 1, wherein said tension setting device includes a dancer roller about which said web is deflected and a device for controlling a position of said dancer roller for selectively increasing and decreasing a deflection of the web between said reel and said process.

3. The strain control configuration according to claim 2, wherein said tension setting device further includes a piston/cylinder assembly operatively connected to said dancer roller and a pressure regulator communicating with said piston/cylinder assembly for adjusting a position of said dancer roller.

4. The strain control configuration according to claim 1, wherein said drive circuit is configured to calculate the caliper of the web material and programmed to adjust the tension of the web in dependence on the caliper to maintain a substantially constant strain on the web.

5. The strain control configuration according to claim 4, wherein said drive circuit is configured to adjust the strain on the web to a desired strain set at a given input of said drive circuit.

6. The strain control configuration according to claim 1, wherein said drive circuit comprises a processor for calculating a desired tension required to maintain the substantially constant strain on the web, and a first converter for converting a signal representing the desired tension to a signal representing a force to be applied to the web.

7. The strain control configuration according to claim 6, wherein said drive circuit further comprises a second converter connected to said first converter for converting the signal representing the force to a signal representing a pressure to be applied to a pressure regulator defining the tension on the web.

8. The strain control configuration according to claim 6, wherein said drive circuit further comprises a feedback loop for iteratively correcting and driving an output signal thereof to a desired strain set at an input thereof.

* * * * *